US007164875B2

(12) United States Patent
Miyabe et al.

(10) Patent No.: US 7,164,875 B2
(45) Date of Patent: Jan. 16, 2007

(54) ELECTROPHOTOGRAPHIC IMAGE FORMING APPARATUS HAVING A PLURALITY OF MOUNTING PORTIONS FOR DETACHABLY MOUNTING A PLURALITY PROCESS CARTRIDGES

(75) Inventors: Shigeo Miyabe, Numazu (JP); Shinjiro Toba, Mishima (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/951,604

(22) Filed: Sep. 29, 2004

(65) Prior Publication Data

US 2005/0220480 A1 Oct. 6, 2005

(30) Foreign Application Priority Data

Mar. 30, 2004 (JP) ..... 2004/099503
Mar. 30, 2004 (JP) ..... 2004/099504
May 14, 2004 (JP) ..... 2004/144839
Aug. 31, 2004 (JP) ..... 2004/253011

(51) Int. Cl.
*G03G 21/16* (2006.01)

(52) U.S. Cl. ..... 399/111

(58) Field of Classification Search ..... None
See application file for complete search history.

(56) References Cited

U.S. PATENT DOCUMENTS

2001/0055499 A1 12/2001 Sato ..... 399/111
2002/0012547 A1* 1/2002 Mae ..... 399/110
2002/0085854 A1 7/2002 Numagami et al. ..... 499/90
2003/0185589 A1* 10/2003 Fujita ..... 399/111
2004/0033092 A1* 2/2004 Aruga ..... 399/329
2004/0096239 A1* 5/2004 Hosokawa et al. ..... 399/111
2004/0101327 A1* 5/2004 Nomura et al. ..... 399/111
2005/0047804 A1* 3/2005 Kosuge ..... 399/27

FOREIGN PATENT DOCUMENTS

JP 8 190245 A 7/1996

* cited by examiner

*Primary Examiner*—Quana Grainger
(74) *Attorney, Agent, or Firm*—Fitzpatrick, Cella, Harper & Scinto

(57) ABSTRACT

An electrophotographic image forming apparatus usable with process cartridges. The apparatus includes mounting portions for detachably mounting the cartridges. In each mounting portion, a cartridge is inclined downwardly from an upstream to a downstream side with respect to a mounting direction and a phantom plane passing through axes of the drums is inclined toward a downstream side with respect to the mounting direction from a bottom part to a top part of the phantom plane. Parts of cartridges mounted to a lower one and the next higher one of the mounting portions overlap, as seen along a plane perpendicular to the phantom plane from an upstream side with respect to the mounting direction. The apparatus also has a light projector and a feeder for feeding recording material, and the cartridges are mounted to or demounted from respective mounting portions from above the perpendicular plane.

7 Claims, 10 Drawing Sheets

ELECTROPHOTOGRAPHIC IMAGE FORMING APPARATUS HAVING A PLURALITY OF MOUNTING PORTIONS FOR DETACHABLY MOUNTING A PLURALITY PROCESS CARTRIDGES

FIELD OF THE INVENTION AND RELATED ART

The present invention relates to an electrophotographic image forming apparatus which forms images by employing a plurality of process cartridges removably mounted in the main assembly of the apparatus.

As for the examples of the above-mentioned electrophotographic image forming apparatus, there are an electrophotographic copying machine, an electrophotographic printer (for example, a laser beam printer, an LED printer, etc.), a facsimile machine, a word processor, etc.

BACKGROUND TECHNOLOGIES

As an electrophotographic color image forming apparatus in accordance with the prior art, a color image forming apparatus of the so-called tandem type has been known, in which four process cartridges for forming toner images of cyan, magenta, yellow, and black colors, one for one, are vertically stacked in parallel, virtually in a straight line. A tandem type color image forming apparatus is designed so that the developing devices of the plurality of cartridges, in which toners different in color are stored one for one are enabled to carry out the development operation roughly at the same time. Therefore, a tandem type color image forming apparatus can form an image at a high speed.

In some of the tandem type color image forming apparatuses, the plurality of process cartridges are vertically stacked in parallel (which hereinafter will be referred to as a vertical tandem type), being therefore smaller in footprint (Japanese Laid-open Patent Application B-190245).

To define a tandem type electrostatic image forming apparatus, it is an image forming apparatus for forming an image such as a color image, which comprises a plurality of electrophotographic image forming means (stations) stacked in parallel in the direction parallel to the direction in which the intermediary transfer member or electrostatic transfer belt is moved.

A vertical tandem design, however, is likely to make the apparatus taller. In recent years, on the other hand, demand has been increasing for a personal desktop printer, and a desktop printer which can be shared by two or more persons. Therefore, a printer is desired to be minimized in height, because it is likely to be placed on a desk.

Thus, in some of the tandem type image forming apparatuses, the plurality of process cartridges are stacked in parallel in a direction that is slightly tilted relative to the vertical line (intermediary transfer member is slightly tilted) (US AA 2001055499).

SUMMARY OF THE INVENTION

The present invention is a further development of the above described prior art.

A primary object of the present invention is to provide an electrophotographic image forming apparatus substantially smaller in the vertical dimension than an electrophotographic image forming apparatus in accordance with the prior art.

Another object of the present invention is to provide an electrophotographic image forming apparatus superior to an image forming apparatus in accordance with the prior art in terms of operational efficiency in mounting a process cartridge into the main assembly of the image forming apparatus, and dismounting it therefrom.

Another object of the present invention is to provide an electrophotographic image forming apparatus having a plurality of process cartridge compartments in which a plurality of process cartridges are removably mountable, one for one, and which are stacked in such a manner that a hypothetical plane which coincides with the axial lines of the photosensitive drums of the plurality of process cartridges in the cartridge compartments of the main assembly is tilted downward relative to the vertical line, as seen from the upstream side, in terms of the direction in which the process cartridges are mounted into the main assembly of the electrophotographic image forming apparatus, so that an operator can mount the plurality of process cartridges into the main assembly, or remove them therefrom with substantially greater operational efficiency than a plurality of process cartridges can be mounted into or removed from a main assembly of an electrophotographic image forming apparatus in accordance with the prior art.

Another object of the present invention is to provide an electrophotographic image forming apparatus having a plurality of process cartridge compartments in which a plurality of process cartridges are removably mountable, one for one and which are stacked in such a manner that a hypothetical plane which coincides with the axial lines of the photosensitive drums of the plurality of process cartridges in the cartridge compartments of the main assembly is tilted downward relative to the vertical line, as seen from the upstream side, in terms of the direction in which the process cartridges are mounted into the main assembly of the electrophotographic image forming apparatus, so that an operator can mount the plurality of process cartridges into the plurality of cartridge compartments of the main assembly, or remove them therefrom, in the direction tilted upward from the plane perpendicular to the above-mentioned plane substantially improving the operational efficiency with which a plurality of process cartridges can be mounted into or removed from the main assembly of an electrophotographic image forming apparatus as compared to the prior art.

Another object of the present invention is to provide an electrophotographic image forming apparatus for forming images on recording medium, having a plurality of cartridge compartments in which a plurality of process cartridges are provided. Each process cartridge comprises: an electrophotographic photosensitive drum; a development roller for developing the electrostatic latent image formed on the peripheral surface of the electrophotographic photosensitive drum; a developer storage portion for storing developer used for the process in which the electrostatic latent image is developed by the development roller; a cleaning member for removing from the electrophotographic photosensitive drum the developer remaining on the electrophotographic photosensitive drum after the transfer of the developer image, formed on the electrophotographic photosensitive drum by the development roller, onto recording medium; and a waste developer storage portion in which the waste developer removed from the electrophotographic photosensitive drum by the cleaning member is stored. The plurality of process cartridge compartments are stacked in such a manner that a hypothetical first plane which coincides with the axial lines of the photosensitive drums of the plurality of process cartridges in the cartridge compartments of the main assembly is tilted downward relative to the vertical line, as seen from the upstream side, in terms of the direction in which the process cartridges are mounted into the main assembly of the electrophotographic image forming apparatus, and that, of two cartridges mounted in two adjacent process cartridge compartments, in terms of the vertical direction, a part of the process cartridge in the top cartridge compartment, and a part of the process cartridge mounted in the bottom cartridge compartment, overlap each other, as seen from the upstream side of a second plane perpendicular to the above-mentioned first plane, in terms of the cartridge insertion direction. The plurality of process cartridge compartments also comprises: a plurality of light projecting means for projecting a beam of light onto the electrophotographic photosensitive drums of the process cartridges mounted in the plurality of cartridge compartments while modulating the beam of light with image formation data; a conveying means for conveying a recording medium. The plurality of process cartridges are mounted into the plurality of cartridge compartments, or removed therefrom, one for one, at an upward angle relative to the abovementioned second plane perpendicular to the first plane.

Another object of the present invention is to provide an electrophotographic image forming apparatus having a plurality of cartridge compartments in which a plurality of process cartridges are provided. Each process cartridge comprises a top unit having: an electrophotographic photosensitive drum; a cleaning member for removing from the electrophotographic photosensitive drum the developer remaining on the electrophotographic photosensitive drum after the transfer of the developer image, formed on the electrophotographic photosensitive drum by the development roller, onto recording medium; and a waste developer storage portion in which the waste developer removed from the electrophotographic photosensitive drum by the cleaning member is stored. Each process cartridge also comprises a bottom unit having: a development roller for developing the electrostatic latent image formed on the peripheral surface of the electrophotographic photosensitive drum; and a developer storage portion for storing developer used for the process in which the electrostatic latent image is developed by the development roller. The top and bottom units are connected by a pair of connective pins so that the two units can be pivoted about the connective pins. The plurality of process cartridge compartments are stacked in such a manner that a hypothetical first plane which coincides with the axial lines of the photosensitive drums of the plurality of process cartridges in the cartridge compartments of the main assembly is tilted downward relative to the vertical line, as seen from the upstream side, in terms of the direction in which the process cartridges are mounted into the main assembly of the electrophotographic image forming apparatus. The process cartridge compartments also, comprise a plurality of light projecting means for projecting a beam of light onto the electrophotographic photosensitive drums of the process cartridges mounted in the plurality of cartridge compartments while modulating the beam of light with image formation data at an upward angle relative to a second plane perpendicular to the above-mentioned first plane which coincides with the axial lines of the electrophotographic photographic drums; and a conveying means for conveying a recording medium. The plurality of process cartridges are mounted into the plurality of cartridge compartments, or removed therefrom, one for one at an upward angle relative to the abovementioned second plane perpendicular to the first plane.

According to an aspect of the present invention, there is provided an electrophotographic image forming apparatus for forming an image on a recording material. The image forming apparatus is usable with a process cartridge. The process cartridge includes an electrophotographic photosensitive drum, a developing roller for developing an electrostatic latent image formed on the electrophotographic photosensitive drum, a developer accommodating portion for accommodating a developer to be used by the developing roller to develop the electrostatic latent image, a cleaning member for removing from the electrophotographic photosensitive drum the developer remaining on the electrophotographic photosensitive drum after a developed image formed on the electrophotographic photosensitive drum is transferred onto the recording material, and a removed developer accommodating portion for accommodating the removed developer removed from the electrophotographic photosensitive drum by the cleaning member. The apparatus comprises a plurality of mounting portions for detachably mounting the process cartridges. In each of the mounting portions, the process cartridge is mounted such that the process cartridge is inclined downwardly from an upstream side to a downstream side with respect to a mounting direction in which the process cartridge is mounted to the main assembly of the electrophotographic image forming apparatus and such that when the process cartridge is set in the mounting portion, a phantom plane passing through axes of the electrophotographic photosensitive drums is inclined toward a downstream side with respect to the mounting direction from a bottom part to a top part of the phantom plane. In addition, a part of the process cartridge mounted to a relatively lower one of the mounting portions and a part of the process cartridge mounted to an immediately upper one of the mounting portions are overlapped with each other, as seen along a plane perpendicular to the phantom plane from an upstream side with respect to the mounting direction. In each mounting portion, also provided is light projecting means for projecting light corresponding to image information onto the electrophotographic photosensitive drum of the process cartridge mounted to the mounting portion, and feeding means for feeding the recording material. The process cartridges are mounted to or demounted from respective mounting portions from above the perpendicular plane.

According to another aspect of the present invention there is provided an electrophotographic image forming apparatus for forming an image on a recording material. The image forming apparatus is usable with a process cartridge. The process cartridge includes an electrophotographic photosensitive drum, a developing roller for developing an electrostatic latent image formed on the electrophotographic photosensitive drum, a developer accommodating portion for accommodating a developer to be used by the developing roller to develop the electrostatic latent image, a cleaning member for removing from the electrophotographic photosensitive drum the developer remaining on the electrophotographic photosensitive drum after a developed image formed on the electrophotographic photosensitive drum is transferred onto the recording material, and a removed developer accommodating portion for accommodating the removed developer removed from the electrophotographic photosensitive drum by the cleaning member. An upper unit contains the electrophotographic photosensitive drum, the cleaning member and the removed developer accommodating portion. A lower unit contains the developer accommodating portion and is rotatably connected with the upper unit. The apparatus comprises a plurality of mounting portions for detachably mounting the process cartridges. In in each of the mounting portions, the process cartridge is mounted such that the process cartridge is inclined downwardly from an upstream side to a downstream side with respect to a mounting direction in which the process cartridge is mounted to the main assembly of the electrophotographic image forming apparatus and such that when the process cartridge is set in the mounting portion, a phantom plane passing through axes of the electrophotographic photosensitive drums is inclined toward toward a downstream side with respect to the mounting direction from a bottom part to a top part of the phantom plane. In addition, in each mounting portion is light projecting means for projecting a laser beam corresponding to image information onto the electrophotographic photosensitive drum mounted to the mounting portion. The light projecting means applies the light from above a plane which is perpendicular to the phantom plane and which passes through an axis of the photosensitive drum. Further in each mounting portion is feeding means for feeding the recording material. The process cartridges are mounted to or demounted from respective mounting portions from above the perpendicular plane.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter the preferred embodiments of the present invention will be described with reference to the appended drawings.

Embodiment 1

(1) General Structure of Electrophotographic Color Image Forming Apparatus

Figure 1:
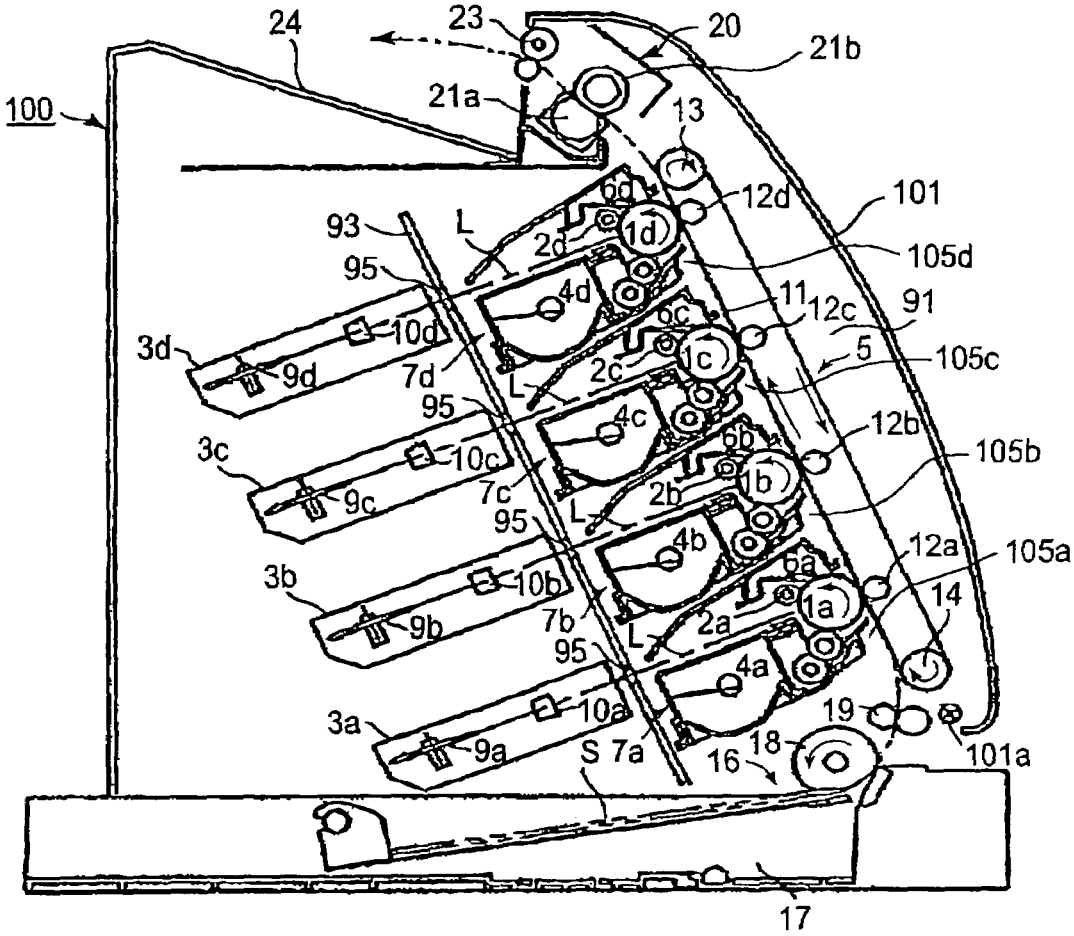
FIG. 1 is a schematic, vertical sectional view of the image forming apparatus in the first embodiment of the present invention, showing the general structure thereof.

FIG. 1 is a schematic vertical sectional view of the electrophotographic image forming apparatus (electrophotographic color image forming apparatus) which is used with the first to fourth process cartridges mounted therein. This apparatus is an electrophotographic full-color laser beam printer. It employs a transfer system and a vertical tandem system, and is designed to be used with a plurality of process cartridges removably mounted in the main assembly thereof.

The main assembly 100 of the image forming apparatus (which hereinafter will be referred to simply as the main assembly) has a front door as a hinged member (which hereinafter will be referred to as the front door) 101 which is rotatably opened toward an operator, or closed away from the operator, about the hinge 101*a* located at the bottom edge of the door 101. In other words, the hinged front door 101 is attached to the upstream side of the main assembly 100 in terms of the direction A in which the cartridges 7 are mounted into the main assembly 100. The cartridges 7 are to be mounted into the main assembly 100 or removed therefrom by an operator through the opening 91 of the main assembly 100 exposed by the opening of the front door 101.

Figure 2:
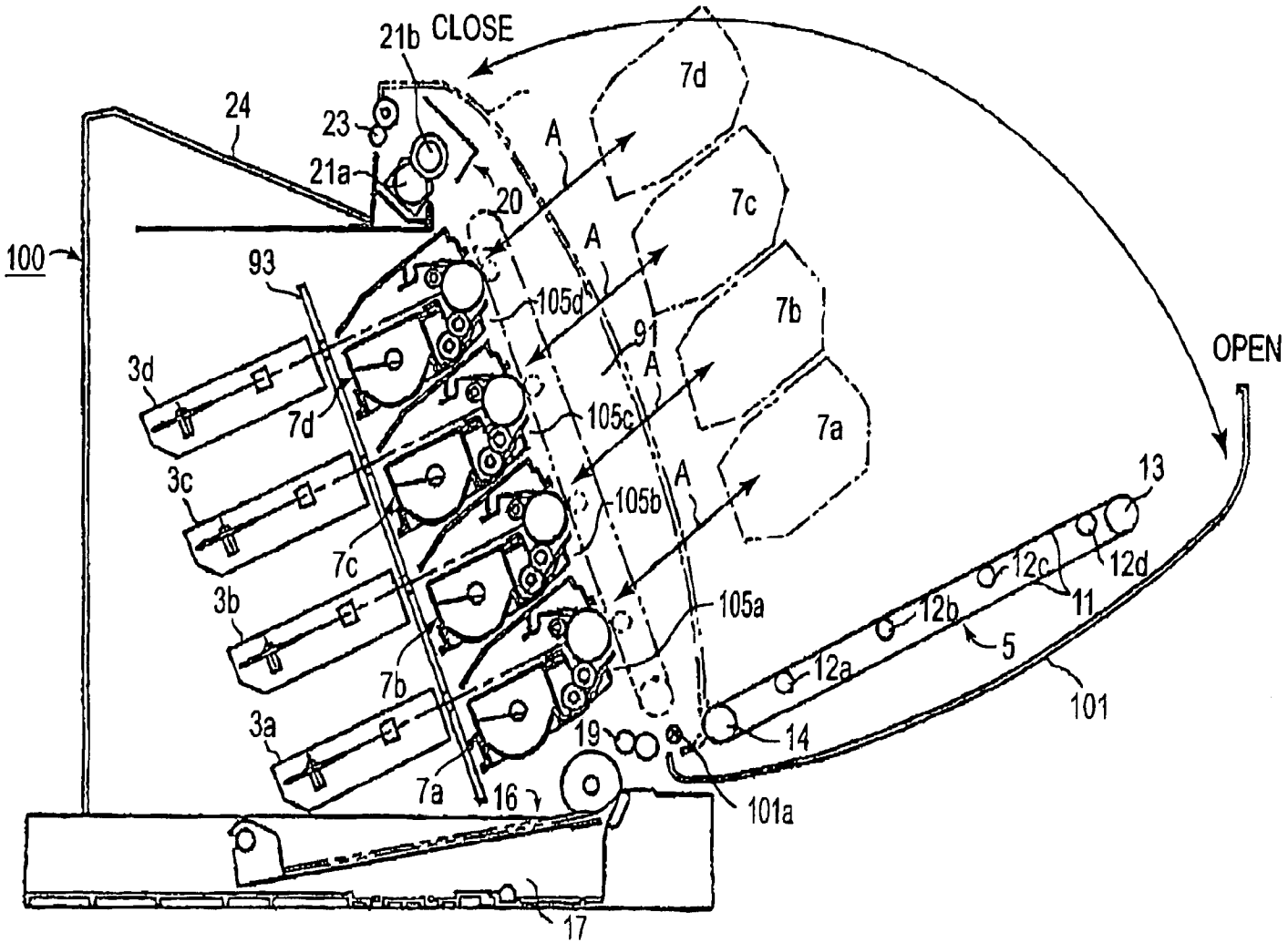
FIG. 2 is a schematic, vertical sectional view of the image forming apparatus in the first embodiment of the present invention, the front cover of which is open to expose the cartridge insertion openings.

FIG. 1 shows the image forming apparatus in the state in which its front door 101 is closed against the main assembly 100, whereas FIG. 2 shows the image forming apparatus in the state in which its front door 101 has been opened toward an operator, with the opening 91 of the main assembly 100 being exposed.

The first to fourth process cartridges (which hereinafter may be simply referred to as cartridges) 7(*a–d*)) develop four latent images corresponding one for one to the four color components into which the optical image of an intended full-color image is separated, into four visible images, that is, images (toner images) formed of magenta, cyan, yellow, and black developers (toners), respectively. These cartridges 7(*a–d*) (magenta, cyan, yellow, and black color development cartridges, listing from the bottom) are stacked in parallel in the direction slightly angled relative to the vertical direction, in the main assembly 100. Each of the cartridges 7(*a–d*) comprises an electrophotographic photosensitive drum (which hereinafter will be referred to as the photosensitive drum) 1(*a–d*). It also has a charging apparatus (charging means) 2(*a–d*) for uniformly charging the peripheral surface of the photosensitive drum 1. Further, it has a developing apparatus (developing means) 4(*a–d*) for developing the electrostatic latent image formed on the peripheral surface of the photosensitive drum 1; it has a developing apparatus (developing means) 4(*a–d*) for developing the electrostatic latent image into an visible image (formed of toner) by adhering single-component developer (which hereinafter may be simply referred to as toner) as developer. In addition, each of the cartridges 7(*a–d*) has a cleaning apparatus (cleaning means) 6(*a–d*) for removing the toner remaining on the peripheral surface of the photosensitive drum 1 after the transfer of the toner images onto a recording medium.

The developers stored in the developing apparatuses 4(*a–d*) of the first to fourth cartridges 7(*a–d*) are magenta, cyan, yellow, and black toners, respectively.

The scanner units 3(*a–d*) are located so that they oppose the above-mentioned four cartridges 7(*a–d*). They are the means for projecting a beam of light upon the peripheral surfaces of the photosensitive drums 1(*a–d*) of the cartridges 7(*a–d*), respectively, while modulating the beam of light with image formation data; they form an electrostatic latent image on the photosensitive drums 1(*a–d*) by projecting a beam of laser light emitted from a semiconductor laser element, upon photosensitive drums 1(*a–d*). Each of the scanner units 3(*a–d*) has a semiconductor laser element (unshown), a polygon mirror 9(*a–d*), which is rotated at a high speed, a focal lens 10(*a–d*), etc. The set of the four cartridges 7(*a–d*) and the set of the four scanner units 3(*a–d*) are partitioned by an intermediary plate (partition wall) 93 located in the apparatus main assembly 100. The beam of laser light outputted from each of the scanner units 3(*a–d*) is made to enter the corresponding cartridge 7(*a–d*) through the corresponding window 95 with which the intermediary plate 93 is provided, so that the peripheral surface of each photosensitive drum 1(*a–d*) is scanned (exposed) by the beam of laser light. A reference letter L designates the path of the beam of laser light.

The electrostatic transferring apparatus (electrostatic transferring means) 5 is held to the inward side of the front door 101. The electrostatic transferring apparatus 5 has: an endless electrostatic transfer belt 11; a driving roller 13, or the roller on the top side; a tension roller 14, or the roller on the bottom side; and four transfer rollers 12(*a–d*). The endless electrostatic transfer belt 11 is stretched around the driving roller 13 and tension roller 14, being suspended by them. Since the electrostatic transferring apparatus 5 is held to the inward side of the front door 101, the front door 101 is opened or closed, while holding the transferring apparatus 5. When the image forming apparatus is in the state shown in FIG. 1, that is, when the front door 101 is closed, the electrostatic transferring apparatus 5 opposes all of the photosensitive drums 1(*a–d*) of the first to fourth cartridges 7(*a–d*). The transfer rollers 12(*a–d*) are positioned within the loop of the endless electrostatic transfer belt 11 so that when the front door 101 is in the closed state. they are kept pressed against the photosensitive drums 1(*a–d*) of the first to fourth cartridge 7(*a–d*), with the electrostatic transfer belt 11 pinched between the transfer rollers 12(*a–d*) and photosensitive drums 1(*a–d*), respectively.

Each scanner unit 3(*a–d*) is positioned on the downstream of the corresponding cartridge compartment 200 of the apparatus main assembly 100, in terms of the aforementioned cartridge mounting direction A. In other words, listing from the upstream in terms of the cartridge mounting direction A, the front door 101, transfer belt 11, cartridge compartment 200, and scanner units 3(*a–d*) are positioned in this order. An operator is to mount or dismount the cartridges 7(*a–d*) from the upstream side of the image forming apparatus.

The recording medium feeding portion 16 is located in the bottom portion of the apparatus main assembly 100. It conveys a recording medium S to the electrostatic transfer belt 11 as the conveying means of the transferring apparatus 5. In this embodiment, the recording medium S is a medium in the form of a sheet, for example, a sheet of paper, an OHP sheet, etc. The recording medium feeding portion 16 comprises a cassette 17 in which the recording mediums S are stored, a feed roller (semicylindrical roller) 18, and a pair of registration rollers 19.

The fixing portion 20 is in the top portion of the apparatus main assembly 100. It fixes to the recording medium S the plurality of toner images different in color which have been transferred onto the recording medium S. The fixing portion 20 comprises: a rotational heat roller 21*a*; a pressure roller 21*b* kept pressed against the heat roller 21*a* to apply pressure to the recording medium S; etc. A pair of discharge rollers 23 discharge the recording medium S, on which an image has been formed, into the delivery tray 24 located on top of the apparatus main assembly 100.

The photosensitive drums 1(*a–d*) of the first to fourth cartridges 7(*a–d*) are sequentially rotated in the counterclockwise direction (indicated by arrow mark in FIG. 1) in accordance with the predetermined timing in the image formation sequence. As the photosensitive drums 1(*a–d*) are rotated, the scanner units 3(*a–d*) are sequentially driven in synchronism with the rotations of the corresponding photosensitive drums 1(*a–d*) in the cartridges 7(*a–d*), respectively. Further, the transfer belt 11 of the transferring apparatus 5 is rotationally driven by the driving roller 13 in the clockwise direction (indicated by arrow mark in FIG. 1).

As the photosensitive drums 1(*a–d*) are rotated, they are uniformly charged by the charging apparatuses 2(*a–d*) to a predetermined polarity (negative polarity in this embodiment) and potential level. Thereafter, electrostatic latent images in accordance with image formation data are formed on the photosensitive drums 1(*a–d*) by the beam of laser light L outputted from the scanner units 3(*a–d*) while being modulated with the image formation data.

The electrostatic latent images are developed (in this embodiment, reversely developed with the use of toner, the inherent polarity of which is negative) into visible images (images formed of toner) by the developing apparatuses 4(*a–d*). As a result, toner images of magenta, cyan, yellow, and black colors are formed on the photosensitive drums 1(*a–d*), respectively, in the predetermined sequence.

Meanwhile, the feed roller 18 is rotated with the predetermined timing, conveying the recording media S from the cassette 17, into the apparatus main assembly 100. Each recording medium S is kept on standby as its leading edge comes into contact with the nip between the pair of registration rollers 19. Then, it is released by the pair of registration rollers 19, which is rotated in synchronism with the rotation of the transfer belt 11 and the progression of the sequential formation of toner images on the photosensitive drums 1(*a–d*). As a result, the recording medium S is delivered to the transfer belt 11, and is conveyed to the transfer station by the rotation of the transfer belt 11 while being firmly held to the surface of the transfer belt 11 by the static electricity of the transfer belt 11.

More specifically, the recording medium S is conveyed upward by the rotation of the electrostatic transfer belt 11 from the bottom of the main assembly 100, and while the recording medium S is conveyed upward, it sequentially receives in layers the magenta, cyan, yellow, and black toner images formed on the peripheral surfaces of the photosensitive drums 1(*a–d*), in the transfer stations, which are the contact areas between the photosensitive drums 1(*a–d*) and transfer belt 11. After the reception in layers of the toner images different in color, the recording medium S is separated from the transfer belt 11 with the utilization of the curvature of the transfer belt driving roller 13, and is conveyed into the fixation station 20. In the fixation station 20, the recording medium S is conveyed through the fixation nip between the heat roller 21*a*, and the pressure roller 21*b* kept pressed against the heat roller 21*a*, while remaining pinched between the two rollers 21*a* and 21*b*, being therefore subjected to the heat and pressure applied by the two rollers 21*a* and 21*b*. As a result, the plurality of toner images different in color are fixed to the surface of the recording medium S. Thereafter, the recording medium S is discharged by the pair of discharge rollers 23 into the delivery tray 24 located outside the apparatus main assembly 100, with its image bearing surface facing downward.

After the transfer of the toner images onto the recording medium S, the photosensitive drums 1(*a–d*) are cleared of such residues as the toner remaining adhered to the peripheral surfaces of the photosensitive drums 1(*a–d*), by the cleaning apparatuses 1(*a–d*).

(2) Process Cartridge 7

Figure 3:
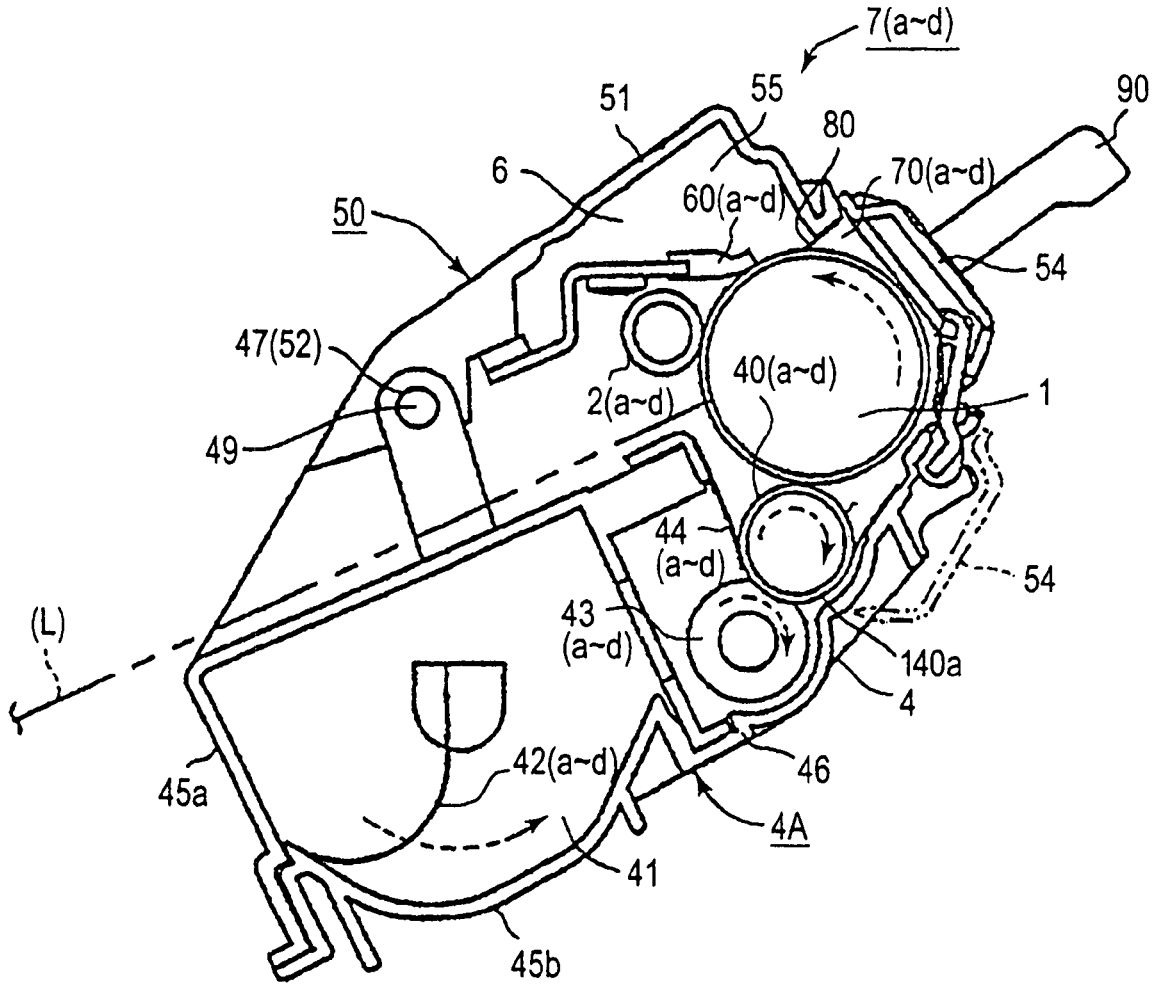
FIG. 3 is an enlarged schematic sectional view of the cartridge in the first embodiment, at a plane perpendicular to the lengthwise direction of the cartridge.
Figure 4:
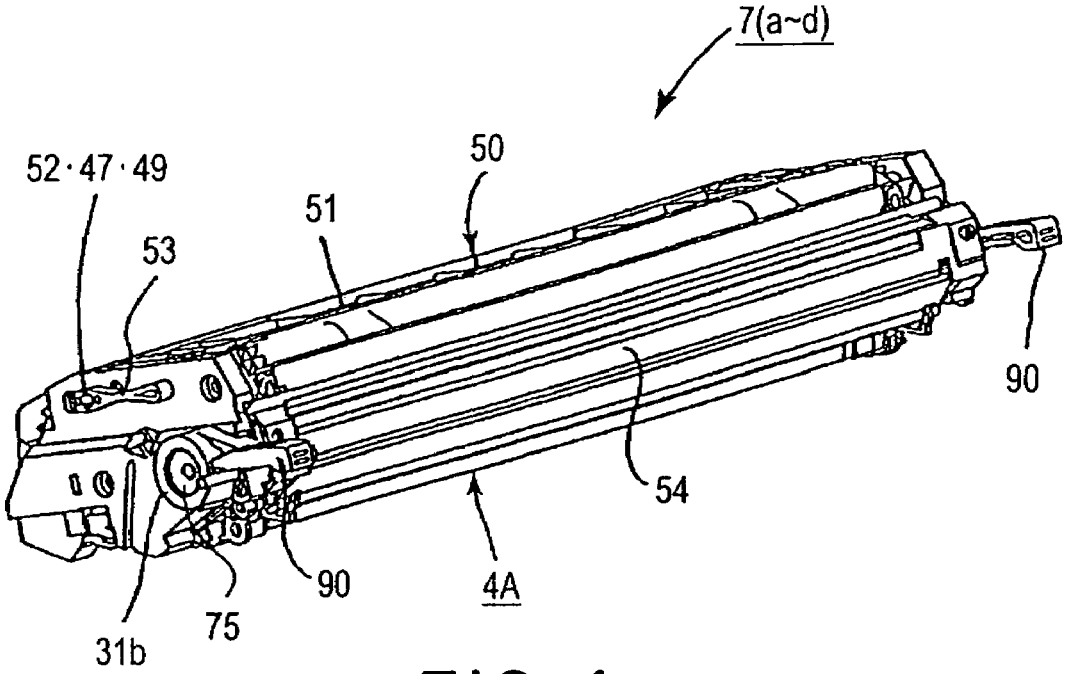
FIG. 4 is a perspective view (No. 1) of the cartridge in the first embodiment.
Figure 5:
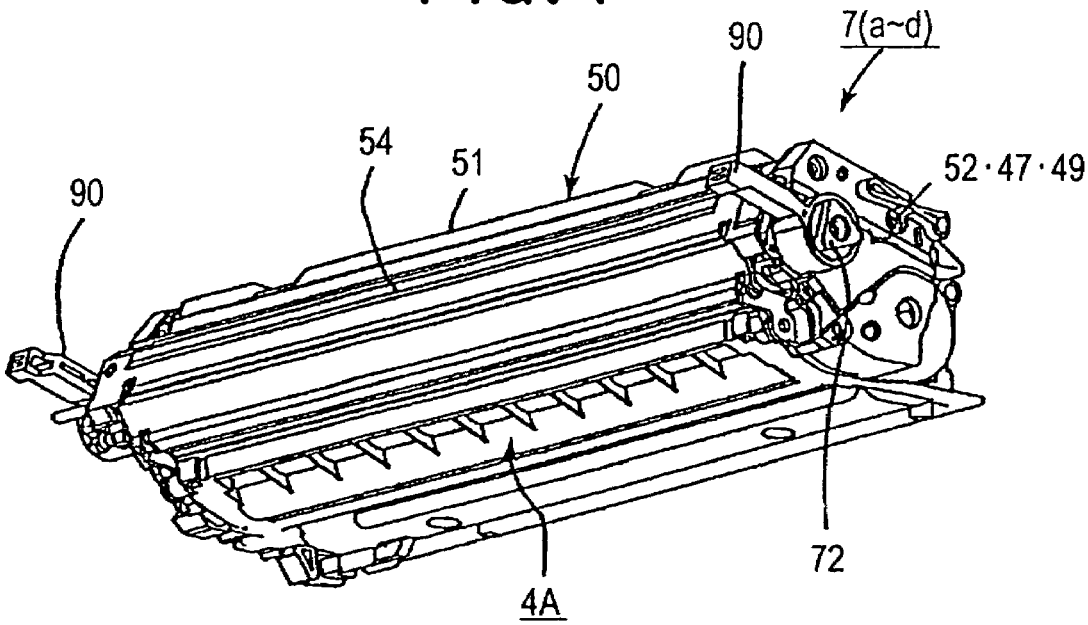
FIG. 5 is a perspective view (No. 2) of the cartridge in the first embodiment.

FIG. 3 is an enlarged schematic sectional view of the cartridge 7, and FIGS. 4 and 5 are perspective views of the cartridge 7.

In this embodiment, the photosensitive drum 1 is one of the integral parts of the cartridge 7. Thus, the photosensitive drum 1 is mounted into the apparatus main assembly 100 or removed therefrom by the mounting of the cartridge 7 into the apparatus main assembly 100 or the removal of the cartridge 7 therefrom.

In the following description of the embodiments of the present invention, the widthwise direction of the cartridge 7 is the direction parallel to the direction in which the cartridge 7 is mounted into the apparatus main assembly 100 or removed therefrom, whereas the lengthwise direction of the cartridge 7 is the direction intersecting the direction in which the cartridge 7 is mounted into or removed from, the apparatus main assembly 100. In other words, the lengthwise direction of the cartridge 7 is the direction parallel to the lengthwise direction of the photosensitive drum 1. The front side of the cartridge 7 is the side which faces upstream in terms of the direction in which the cartridge 7 is mounted into the apparatus main assembly 100; it is the side from which the photosensitive drum 1 is partially exposed. The rear side of the cartridge 7 is the side opposite to the front side. Further, the left and right sides of the cartridge 7 are the left and right sides as the cartridge 7 is seen from the front side. The top side of the cartridge 7 is the side which faces upward when the cartridge 7 is in the image formation position in the apparatus main assembly 100, and the bottom side of the cartridge 7 is the side which faces downward when the cartridge is in the image formation position in the apparatus main assembly 100.

The first to fourth cartridges 7(*a–d*) are identical except for the developers stored in the toner container portions (developer storage portions).

Each cartridge 7 has a top unit (which hereinafter may be referred to as cleaner unit) 50, and a bottom unit (which hereinafter may be referred to as development unit) 4A. In this embodiment the cleaner unit 50 comprises the photosensitive drum 1, one of the charging apparatus 2(*a–d*), and the cleaning apparatus 6, whereas the development unit 4A comprises the developing apparatus 4 for developing the electrostatic latent image on the peripheral surface of the photosensitive drum 1. The two units 4A and 50 are connected with the use of a pair of pins 49, being enable to pivot about the pins 49.

The photosensitive drum 1 is provided with flanges 72 and 75, which are attached to the lengthwise ends of the photosensitive drum 1, one for one. The flanges 72 and 75 are rotatably supported by supporting members (bearings) with which the left and right walls of the cleaning means frame 51 are provided, the bearing that supports the flange 75 being denoted by reference characters 31*b*. Of the two flanges 72 and 75, the flange 72 receives the driving force from the driving force transmitting member (unshown) of the apparatus main assembly 100; the photosensitive drum 1 is rotationally driven through the flange 72.

As each of the charging apparatus 2(*a–d*), an electrically 20 conductive roller of a contact type is employed. The electrically conductive roller 2 is placed in contact with the peripheral surface of the photosensitive drum 1, and is rotated by the rotation of the photosensitive drum 1 while charge bias voltage is applied to the roller 2. As a result, one of the charge rollers 2(*a–d*) uniformly charges the peripheral surface of the photosensitive drum 1.

The toner remaining on the peripheral surface of the photosensitive drum 1 (waste toner: toner remaining on the peripheral surface of the photosensitive drum 1 after the toner image developed on the peripheral surface of the photosensitive drum 1 with developer is transferred onto the recording medium) is removed by the cleaning blade (cleaning member) 60 (the cleaning blades provided for the cartridges 7(*a–d*) being denoted by 60(*a–d*), respectively), and is stored in the waste toner chamber (residual toner storage chamber: storage chamber for removed developer) 55 located above the cleaning blade 60. Incidentally, the toner remaining on the peripheral surface of the photosensitive drum 1 after the toner image transfer therefrom moves past the contact area between the flexible sheet 80 and the peripheral surface of the photosensitive drum 1, and reaches the cleaning blade 60. The flexible sheet 80 prevents the waste toner from leaking out of the cleaning means frame 51 after the waste toner is removed from the cleaning blade 60.

In this embodiment, the development unit 4A comprises a development roller 40 (the development rollers provided for the cartridges 7(*a–d*) being denoted by 40(*a–d*), respectively) for developing the latent image formed on the photosensitive drum 1, and development means frames 45*a* and 45*b*, in which the toner is stored. In the space formed by the developing means frames 45*a* and 45*b*, a development blade 44 as the developer layer regulating member is located (the development blades provided for the cartridges 7(*a–d*) being denoted by 44(*a–d*), respectively). The development roller 40 is rotated in the clockwise direction (indicated by arrow mark), with a minute gap maintained between the peripheral surfaces of the development roller 40 and photosensitive drum 1 by a pair of spacer rings 140*a*. The developing means frames 45*a* and 45*b* are joined with the container unit 46 by ultrasonic welding or the like means. The development roller 40 is rotatably supported by the developing means container unit 46, with a pair of bearings (unshown) placed between the development roller 40 and the unit 46. With the peripheral surface of the development roller 40, the toner supply roller 43 (the toner supply rollers provided for the cartridges 7(*a–d*) being denoted by 43(*a–d*), respectively) which is rotated (clockwise direction indicated by arrow mark) in contact with the development roller 40, and the development blade (developer layer regulating member) 44, are placed in contact. Further, in the toner container portion (developer storage portion) 41, the toner conveyance mechanism 42 (the toner conveyance mechanism provided for the cartridges 7(*a–d*) being denoted by 42(*a–d*), respectively) for conveying toner to the toner supply roller 43 is located. The toner container portion 41 stores the developer to be borne by the development roller 40 to develop the abovementioned latent image.

The developing means container unit 46 is provided with a pair of connective holes 47, which are located at the lengthwise ends thereof, one for one, whereas the left and right walls of the cleaning means frame 51 of the cleaner unit 50 are provided with a pair of supporting holes 52, one for one The developing means container unit 46 and cleaner unit 50 are held relative to each other so that the pair of connective holes 47 align with the pair of supportive holes 52. Then, a pair of pins 49 is inserted through the pair of connective holes 47 and the pair of supportive holes 52. As a result, the two units 46 and 50 are connected so that they can be pivoted about the pair of pins 49. The development unit 4A is kept pressured by the a pair of springs in the direction to rotate about the pair of pins 49 so that the development unit 4A is kept pressured upon the unit 50. Therefore, the pair of the spacers 140*a* of the development roller 40 are kept in contact with the peripheral surface of the photosensitive drum 1.

A beam of laser light is projected from one of the scanner units 3(*a–d*) into the cartridge 7 through the gap between the unit 50 and development unit 4A, exposing the peripheral surface of the photosensitive drum 1 in the cartridge 7. More specifically, the beam of laser 20 light is projected toward the axial line of the photosensitive drum 1. Further, the beam of laser light L(a–d) is projected upon the peripheral surface of the photosensitive drum 1(*a–d*) through the gap between the aforementioned cleaner unit 50 (top unit) and development unit 4A (bottom unit).

During development, the supply roller 43, which is being rotated in the clockwise direction (indicated by arrow mark), rubs the development roller 40, which is being rotated also in the clockwise direction (indicated by arrow mark). As a result, the development roller 40 is supplied with the toner borne on the supply roller 43. As the development roller 40 is further rotated, the toner having adhered to the peripheral surface F of the development roller 40 reaches the development blade 44, which regulates the amount of toner allowed to remain on the peripheral surface F of the development roller 40, forming thereby a uniform layer of toner with a predetermined thickness on the peripheral surface of the development roller 40, while giving the toner a predetermined amount of electric charge. Then, as the development roller 40 is further rotated, the toner on the peripheral surface F of the development roller 40 is conveyed to the development station, or the area in which the peripheral surfaces of the photosensitive drum 1 and development roller 40 are placed extremely close to each other. In the development station, the toner on the peripheral surface F of the development roller 40 is adhered by the development bias applied to the development roller 40 from an electric power source (unshown), to the peripheral surface of the photosensitive drum 1 in the pattern of the electrostatic latent image having formed thereon; in other words, the electrostatic latent image is developed.

The toner remaining on the peripheral surface of the development roller 40 after the development of the electrostatic latent image, that is, the toner on the peripheral surface of the development roller 40, which did not contribute to the development of the latent image, is returned by the further rotation of the development roller 40 into the developing device, in which it is stripped (recovered) by the toner supply roller 43 from the development roller 40, in the contact area between the supply roller 43 and development roller 40.

Designated by a reference numeral 54 is a shutter for protecting the photosensitive drum 1. The shutter 54 is attached to the cleaning means holding frame 51. The shutter 54 is mechanically opened or closed (mechanism is not shown). More specifically, the shutter 54 is movable between the closed position (FIGS. 3–5) in which it covers one of the openings 70(*a–d*), with which the cartridge 7 is provided to transfer the toner onto the recording medium, and the open position (double-dot chain line in FIG. 3), into which it is moved downward to expose the photosensitive drum 1.

Designated by reference numerals 90 are handles located at the left and right ends of the cleaning means frame 51, one for one. The handles 90 are the portions by which the cartridge 7 is to be held by an operator when the cartridge 7 is mounted into the apparatus main assembly 100 or removed therefrom. They project in the upstream direction, in terms of the aforementioned cartridge mounting direction A, from the left and right ends of the cleaning means frame 51.

(3) Method for Mounting or Dismounting Cartridge 7

Figure 6:
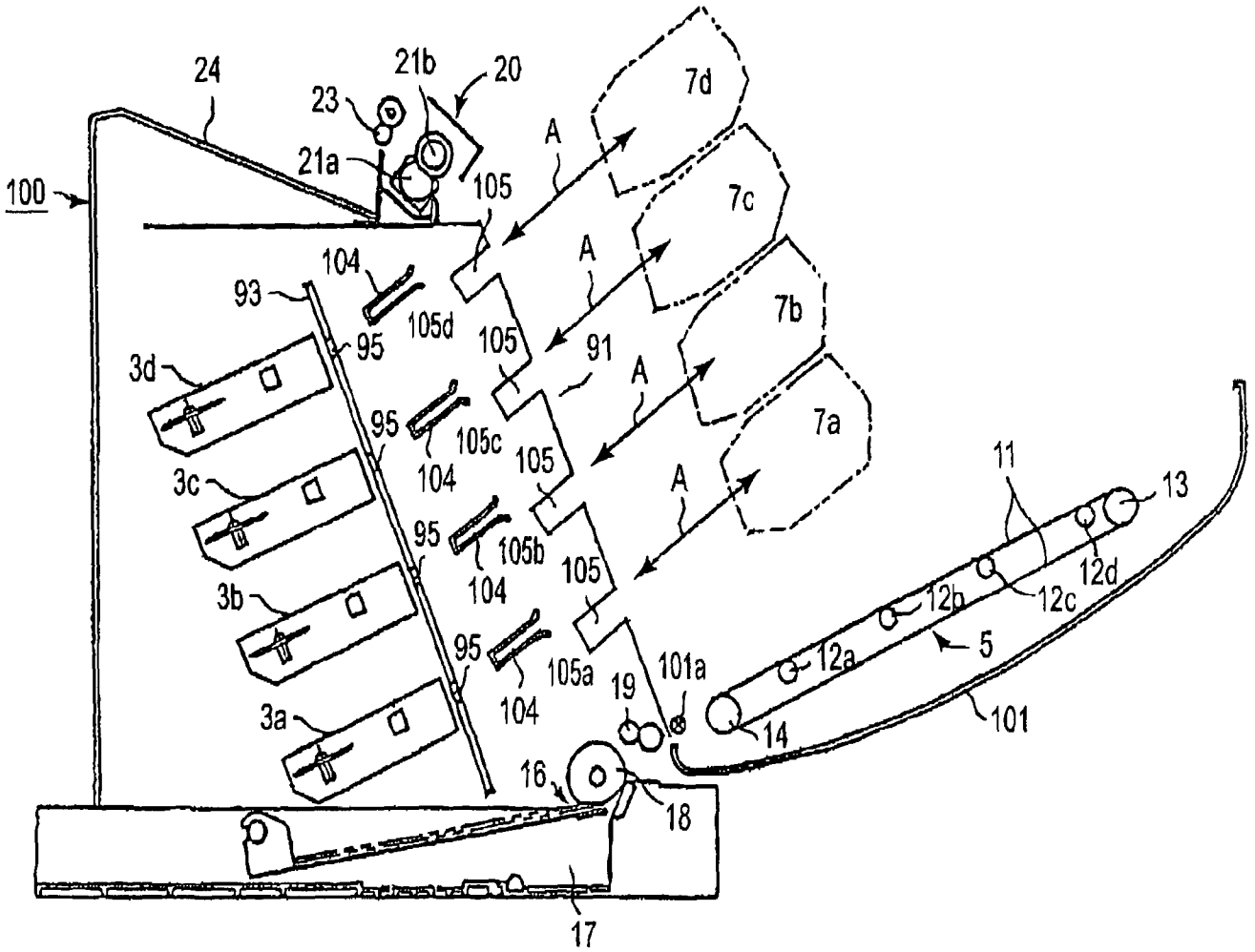
FIG. 6 is a schematic sectional view (No. 1) of the cartridge compartment portion of the main assembly of the image forming apparatus in the first embodiment.
Figure 7:
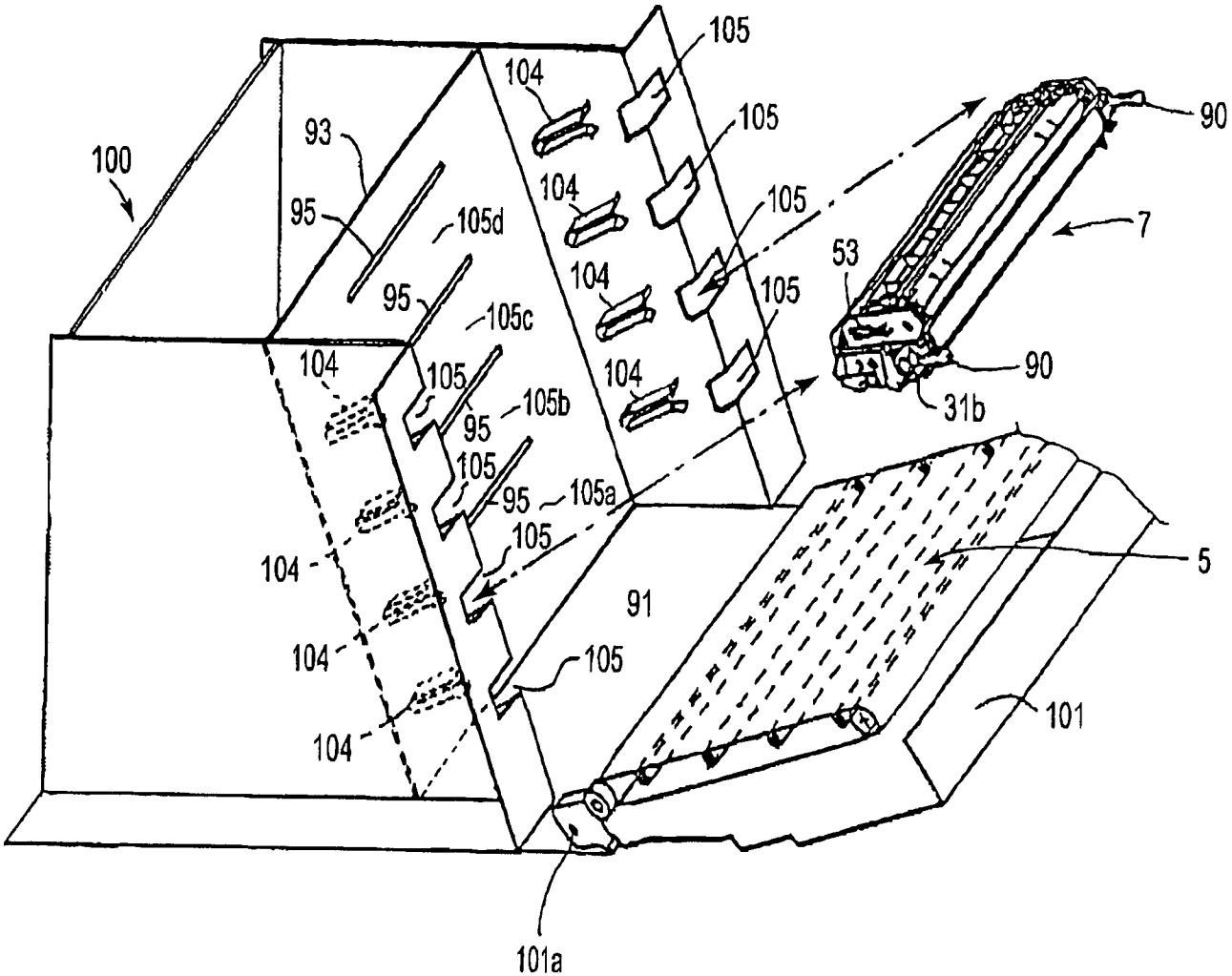
FIG. 7 is a schematic perspective view (No. 2) of the cartridge compartment portion of the main assembly of the image forming apparatus in the first embodiment.

Next, the method for mounting the cartridge 7 into the apparatus main assembly 100 or dismounting it therefrom will be described. Referring to FIGS. 2, 6, and 7, first, the front door 101 must be opened by an operator; the front door 101 must be rotated frontward about the hinge 101*a* (in the upstream direction in terms of cartridge mounting direction). The complete opening of the front door 101 fully exposes the cartridge insertion opening 91 of the apparatus main assembly 100. It should be noted here that as the front door 101 is opened by the operator, the aforementioned transferring apparatus attached to the inward side of the front door 101 also is rotated away from the apparatus main assembly 100 along with the front door 101 as shown in FIG. 2.

The opening of the front door 101 exposes the cartridge insertion opening 91 in which four cartridge compartments 105(*a–d*), into which the cartridges 7(*a–d*) are to be mounted, are located. The four cartridge compartments 105(*a–d*) are virtually vertically stacked, with the cartridge compartment 105*a* being at the bottom and the rest stacked thereon in the alphabetical order.

An operator is to hold the cartridge 7 by the left and right handles 90, by grasping the handles 90 with both hands, and to insert the cartridge 7 into the proper cartridge compartment 105 through the cartridge insertion opening 91, so that the rear side of the cartridge 7, that is, the side opposite to the side where the photosensitive drum 1 is exposed, faces forward, and also, so that the guides 53 of the cartridge 7, located at the left and right ends of the cartridge 7, ride on the guides 104 of the apparatus main assembly 100. As the cartridge 7 is inserted deeper into the apparatus main assembly 100, the aforementioned pair of bearings supporting the flanges 72 and 75 are moved into the pair of guiding grooves (guide rails) 104 of the apparatus main assembly 101, and come into contact with the end walls of the guiding grooves 31*a* and 31*b*, preventing thereby the cartridge 7 from being inserted further into the apparatus main assembly 100, and at the same time; properly positioning the cartridge 7 relative to the cartridge compartment 105 (apparatus main assembly 100). After the mounting of the cartridge 7, the front door 101 is to be closed.

In order to remove the cartridge 7 from the apparatus main assembly 100, the above described procedure for mounting the cartridge 7 into the apparatus main assembly 100 is to be carried out in reverse.

(4) Structural Arrangement for Reducing Apparatus Height

Figure 8:
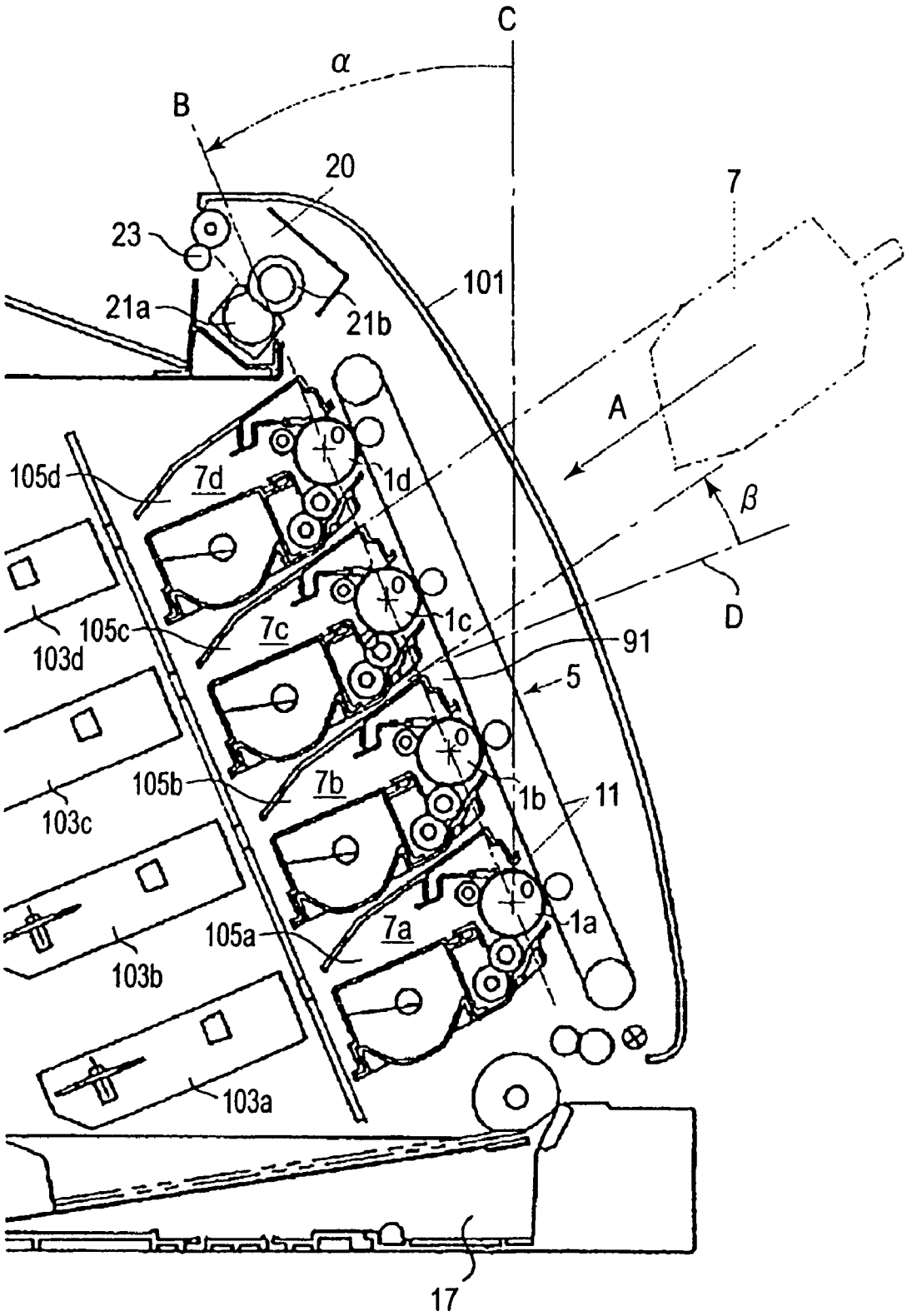
FIG. 8 is a schematic drawing (No. 1) for showing the structural arrangement for reducing the vertical dimension of the image forming apparatus.
Figure 9:
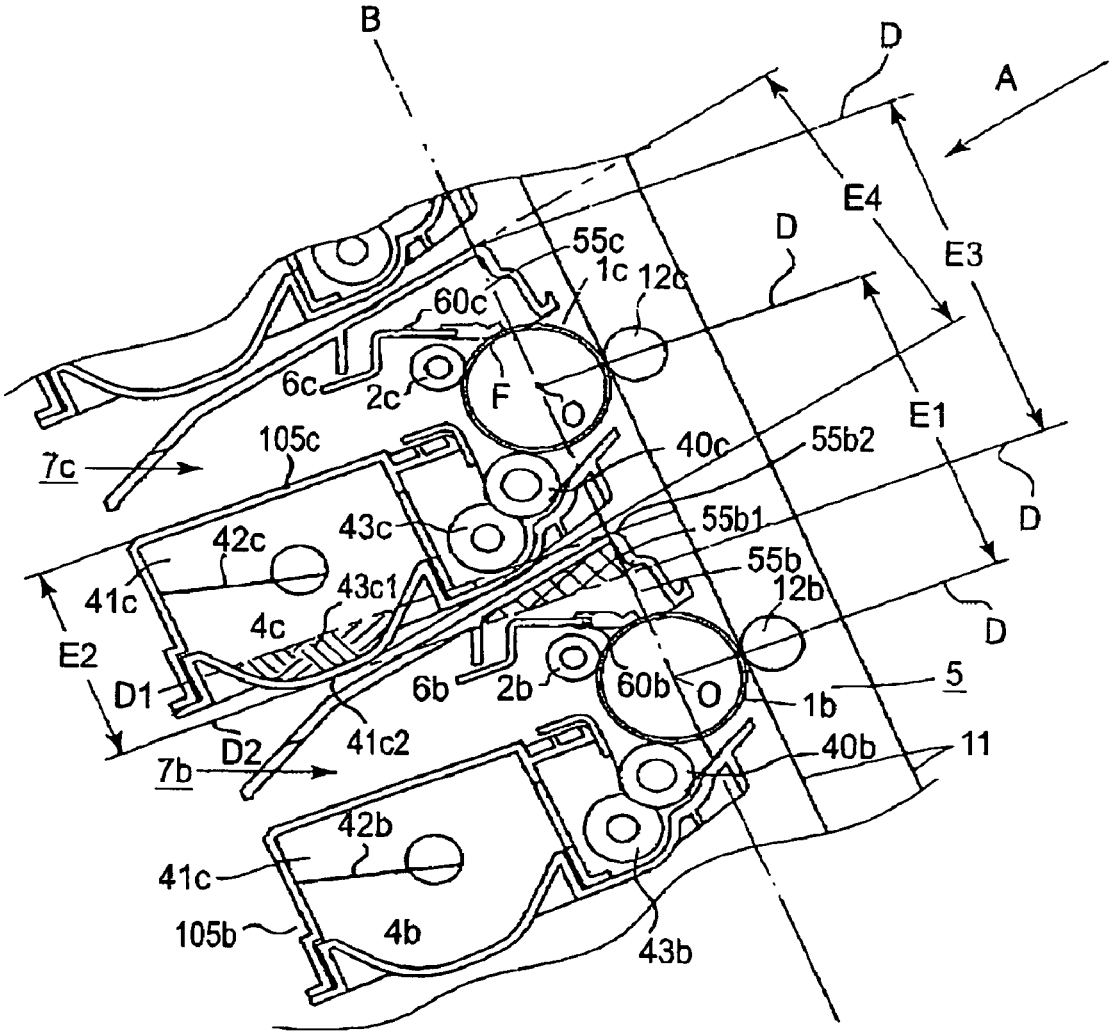
FIG. 9 is a schematic drawing (No. 2) for showing the structural arrangement for reducing the vertical dimension of the image forming apparatus.

Referring mainly to FIGS. 8 and 9, the structural arrangement for reducing the height of the apparatus main assembly 100 will be described.

Each of the cartridges 7(*a*–1) is removably mounted. Each of the cartridge compartments 105(*a–d*) is structured so that as the cartridge 7 is inserted into the cartridge compartment 105, it is slightly tilted downward in terms of the cartridge mounting direction A. The cartridge compartments 105(*a–d*) are the spaces of the apparatus main assembly 100 into which the cartridges 7 are mountable.

The cartridge compartments 105(*a–d*) are tilted 30 that when the cartridges 7(*a–d*) are in the proper positions in the cartridge compartments 105(*a–d*). the hypothetical plane B which coincides with the axial line of each of the photosensitive drums 1(*a–d*) of the cartridges 7(*a–d*) is tilted downstream, in terms of the cartridge mounting direction A, relative to the vertical plane C which coincides with the axial line of the photosensitive drum 1(*a*). A reference letter α for the angle of the hypothetical plane B relative to the vertical plane C. Thus, after the closing of the front door 101, the transfer belt 11, which is extended in contact with the peripheral surfaces of the photosensitive drums 1(*a–d*), being therefore parallel to the hypothetical plane B, is also tilted; in other words, the transfer belt 11 is roughly parallel to the hypothetical plane B. Also referring to FIGS. 8 and 9, designated by a reference letter D is a hypothetical direction (plane) which is perpendicular to the above-mentioned hypothetical plane B. The cartridge compartments 105(*a–d*) are structured so that, as seen from the plane D upstream of the cartridge compartments 105 in terms of the cartridge mounting direction A, a part of the cartridge 7 in the top cartridge compartment of the adjacent two cartridge compartments in the vertical direction, overlaps with a part of the cartridge 7 in the bottom cartridge compartment. More specifically, FIG. 9 shows the relationship between the cartridge 7(*b*) and cartridge 7(*c*). The hatched portions are the portion of the cartridge 7(*b*) in the cartridge compartment on the top side, and the portion of the cartridge 7(*c*) in the cartridge compartment on the bottom side, which overlap.

The cartridge mounting direction A is such a direction that its upstream side is tilted upward relative to the abovementioned hypothetical direction (plane) D. The angle t β at which the cartridge mounting direction A is tilted relative to the hypothetical plane D is set to be no less than 0° and no more than 30°. The angle α is also set to be within the same range as the angle β.

Since the cartridge mounting direction A in this embodiment is tilted as described above, a part 41*c*1 of the toner chamber (developer storage portions) 41*c* of the cartridge 7*c*, or the top cartridge 7 of the two cartridges in the adjacent two cartridge compartments, In terms of the vertical direction, and a part 55*b*1 of the waste toner chamber (waste developer storage portion) 55*b* of the cartridge 7*b*, or the cartridge in the bottom cartridge compartment, overlap in terms of the direction of the plane D. In other words, the portions of the cartridges 7*b* and 7*c*, located between the hypothetical planes D1 and D2 perpendicular to the hypothetical plane B, overlap. The hypothetical plane D1 is the plane which is perpendicular to the plane B, and coincides with the highest point of the cartridge 7*b*, or the cartridge in the bottom cartridge compartment, after the mounting of the cartridge 7*b* into the apparatus main assembly 100. In other words, it is the hypothetical plane which coincides with the external edge 55*b*2 of the waste toner chamber 55*b* and is perpendicular to the plane B. The hypothetical plane D2 is the plane which is perpendicular to the plane B, and coincides with the lowest point of the cartridge 7*c*, or the cartridge in the bottom cartridge compartment, after the mounting of the cartridge 7*c* into the apparatus main assembly 100. In other words, it is the hypothetical plane which coincides with the external edge 41*c*2 of the toner chamber 41*c* and is perpendicular to the plane B.

Incidentally, the above described planes B, D, D1 and D2 are hypothetical planes, being therefore invisible.

With the provision of the above described structural arrangement, the distance E1 between the photosensitive drums 1*b* and 1*c* in the two cartridges 7*b* and 7*c* in the adjacent two cartridge compartments, one for one, in terms of the vertical direction can be substantially reduced compared to that in accordance with the prior art, and in addition, the width E2 of the toner chamber 41*c*, in terms of the direction parallel to the plane B, can be increased. Therefore, even if the cartridge 7 is reduced in size to reduce the image forming apparatus size, the cartridge 7 is not reduced in toner capacity. Further, the toner chamber 41*c* can be made in a virtually cubical shape, making it possible to reduce to one the number of the toner sending mechanisms 42*c* for sending the toner in the toner chamber 41 out of the toner chamber 41. Therefore, the problem that the reduction in cartridge height results in the increase in cartridge cost does not occur.

It has been confirmed through experiments that as the residual toner (waste toner) is removed by the cleaning blade 60 at the cleaning point F, the removed residual toner accumulates on virtually the same area, which is a predictable distance from the cleaning point F, in the waste toner chamber 55*c*. Therefore, by extending the waste toner chamber 55*c* not only toward the deeper end of the cartridge 7 in terms of the cartridge mounting direction A, but also, upward of the blade 60*c*, the waste toner can be efficiently stored in the waste toner chamber 55*c*. In other words, by constructing the waste toner chamber 55*c* as described above, the waste toner chamber 55*c* can be made spatially efficient without increasing the distance E1 between the adjacent two photosensitive drums in terms of the vertical direction.

Although the relationship between the adjacent two cartridges 7 in terms of the vertical direction has been described with reference to that between the cartridges 7*b* and 7*c*, the relationships between the cartridges 7*a* and 7*b*, and between the cartridges 7*c* and 7*d*, are the same as that between the cartridges 7*b* and 7*c*.

As described above according to this embodiment, the cartridge compartments 105(*a–d*) of the main assembly 100 of the image forming apparatus are structured so that the cartridges 7(*a–d*) are removably mountable into the cartridge compartments 105(*a–d*) at a downward angle as seen from the upstream side in terms of the direction A in which the cartridge 7 is mounted into the apparatus main assembly 100; the hypothetical plane B which coincides with the axial line of the photosensitive drum 1 of each of the cartridges 7(*a–d*) in the cartridge compartments 105(*a–d*) is tilted downstream in terms of the aforementioned cartridge mounting direction A, relative to the vertical plane; and a part 55*b*1 of the waste toner chamber 55 (waste developer storage portion) of the cartridge 7 in the bottom cartridge compartments of the adjacent two cartridge compartments, in terms of the vertical direction, overlaps with a part 41*c*1 of the toner chamber 41 (developer storage portion) of the cartridge in the other cartridge compartment, or the top cartridge compartment, of the adjacent two cartridge compartments, as seen from the upstream of the hypothetical direction (plane) D perpendicular to the plane B; and the cartridges 7(*a–d*) are mounted into, or removed from, the cartridge compartments 105(*a–d*) at an upward angle relative to the hypothetical direction (plane) D perpendicular to the hypothetical plane B. With the employment of this structural arrangement, the distance E1 between the cartridges 1 in the adjacent two cartridge compartments 105 in terms of the vertical direction can be substantially reduced compared to that in accordance with the prior art, making it therefore possible to substantially reduce the overall height of the main assembly 100. Moreover, the reduction in the overall height of the image forming apparatus does not result in the degrading of the cartridge 7 in specifications and quality; for example, it is unnecessary to reduce the cartridge in toner capacity, or to shrink the waste toner chamber, in order to reduce the overall height of the image forming apparatus. Further, the cartridge 7 is to be mounted into the apparatus main assembly 100 in the diagonally downward direction, making it easier for the cartridge 7 to be mounted into the apparatus main assembly 100.

Further, referring to FIG. 9, the width E3 of the cartridge 7 in terms of the direction parallel to the plane B is wider than the width E4 of the cartridge 7 in terms of the direction perpendicular to the cartridge mounting direction A. With the employment of this structural arrangement, the distance between the two cartridges in the adjacent two cartridge compartments 105 in terms of the vertical direction can be substantially reduced compared to that in accordance with the prior art. Consequently, the cartridge 7 can be reduced in size.

Also as described above, the cartridge compartments 105(*a–d*) of the main assembly 100 of the image forming apparatus are structured so that the cartridges 7(*a–d*) are removably mountable into the cartridge compartments 105 (*a–d*) at a downward angle as seen from the upstream side in terms of the direction A in which the cartridge 7 is mounted into the apparatus main assembly 100, and the hypothetical plane B which coincides with the axial line of the photosensitive drum 1 of each of the cartridges 7(*a–d*) in the cartridge compartments 105(*a–d*) is tilted downstream in terms of the aforementioned cartridge mounting direction A, relative to the vertical plane. Therefore, it is possible for an operator to mount the cartridges 7(*a–d*) into the apparatus main assembly 100 or remove it therefrom with greater efficiency, because the above described structural arrangement makes the cartridge compartments 105*b*–105*d* slightly offset inward of the apparatus main assembly 100, that is, in the cartridge mounting direction A, from the cartridge located immediately below.

Further, the plurality of cartridge compartments 105(*a–d*), in which the cartridges 7(*a–d*) are removably mountable, are stacked so that after the mounting of the cartridges 7(*a–d*) into the cartridge compartments 105(*a–d*), the hypothetical plane B which coincides with all the axial lines of the photosensitive drums of the cartridges 7(*a–d*), is tilted downstream, in terms of the cartridge mounting direction A, relative to the vertical plane which coincides with the axial line of the photosensitive drum 1*a* in the cartridge 7*a*, and an operator is expected to mount the cartridges 7(*a–d*) into the cartridge compartments 105(*a–d*) or remove them therefrom, at an upward angle relative to the hypothetical plane D perpendicular to the hypothetical plane B, improving thereby the efficiency with which the cartridges 7(*a–d*) are mounted into, or removed from, the apparatus main assembly 100.

Incidentally, in the preceding embodiment, the light projecting means for projecting a beam of light upon the peripheral surface of the peripheral surface of the photosensitive drum 1 while modulating the beam with the image formation data was one of the scanner units 3(*a–d*) which projects the beam of laser light emitted from a semiconductor laser. However, the light projecting means does not need to be limited to the scanner unit. For example, it may be an LED array unit which projects the beam of light emitted from a light emitting diode (LED).

Further, the transfer belt 11 in the preceding embodiment may be replaced with an intermediary transfer belt (intermediary transfer member), onto which the toner images formed in the cartridges are transferred (primary transfer), and from which the transferred toner images are transferred (secondary transfer) onto the recording medium S.

Embodiment 2

Figure 10:
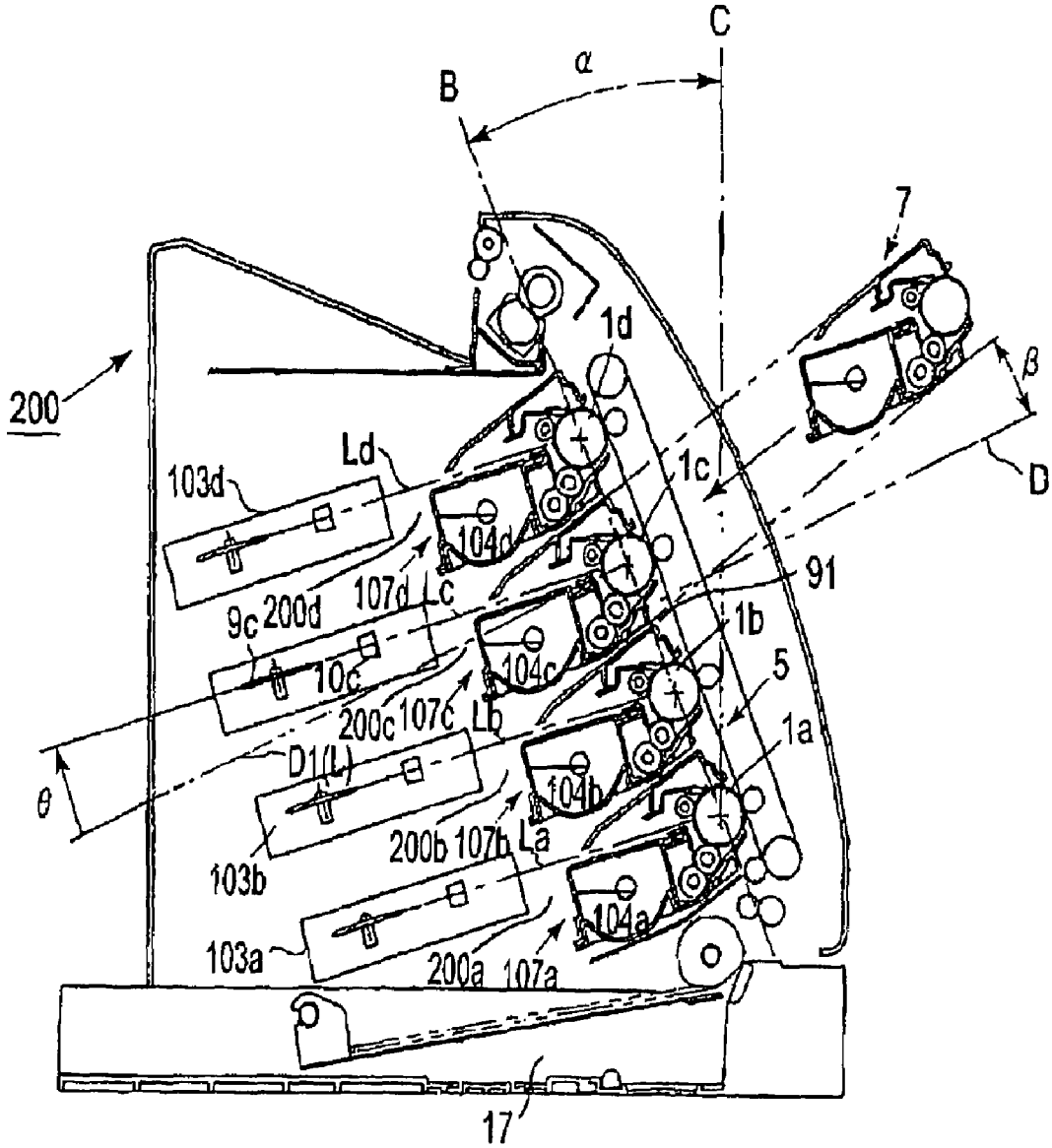
FIG. 10 is a schematic sectional view (No. 2) of the image forming apparatus in the second embodiment of the present invention, showing the general structure thereof and the structural arrangement thereof for reducing the vertical dimension.

Next, referring to FIGS. 10 and 11, the second embodiment of the present invention will be described. The components, members, portions, etc., in this embodiment, which are the same as those in the first embodiment, are given the same referential symbols as those given in the first embodiment, and will not be described here.

The image forming apparatus 200 in this embodiment is virtually the same in structure as that in the first embodiment, except that the apparatus main assembly 200 in this embodiment is structured so that the beam of laser light L projected from each of the scanner units 103(*a–d*) to expose the peripheral surfaces of the photosensitive drums 1(*a–d*) of the corresponding cartridges 107(*a–d*) enters the corresponding cartridge 7(*a–d*) at an upward angle relative to the plane D1 which is perpendicular to the aforementioned plane B and coincides with the axial line of the photosensitive drum 1. Reference symbols La–Ld designate the paths of the beams of laser light L for exposure. The beam of laser light L(a–d) from the scanner units 103(*a–d*) are projected upon the peripheral surfaces of the photosensitive drums 1(*a–d*) through the gaps between the aforementioned cleaner units 50 and development units 4A, respectively. The beams La–Ld of laser light are projected toward the axial lines of the corresponding photosensitive drums 1. In other words, the paths La–Ld of the beams of laser light emitted from the scanner units 103(*a–d*) are tilted upward, that is, toward the scanner units 103(*a–d*), relative to the aforementioned directions (planes) D perpendicular to the plane B and coincide with the axial lines of the photosensitive drums 1 of the corresponding cartridges is 7(*a–d*). The angle θ between the plane D1 perpendicular to the plane B and the paths La–Ld of the beams of exposure light is set to be no less than 0° and no more than roughly 10°.

Incidentally, the path L of the beam of the exposure light in the image forming apparatus in the first embodiment coincides with the plane D1 perpendicular to the plane B. The paths La–Ld of the exposure light in this embodiment are tilted upward, in FIG. 11, by the angle θ about the axial lines of the photosensitive drums 1(*a–d*). With the employment of this structural arrangement, the development units 104(*a–d*) can be rotated upward (lifted) about the axial lines of the photosensitive drums 1(*a–d*) by the angle θ. In other words, the development units 104(*a–d*) can be rotated so that their bottom surfaces Z can be positioned substantially higher relative to the apparatus main assembly 100 than they could according to the prior art. Therefore, the guiding grooves of the cartridge compartments 105(*a–d*), and the guiding portions 104 of the apparatus main assembly 100 (not shown in FIGS. 10 and 11) can be tilted upward by the angle θ as described above, making it possible to further reduce the distance between the two cartridges 7 in the adjacent two cartridge compartments in terms of the vertical direction, and therefore, to reduce the height of the image forming apparatus. Obviously, the same effects as those realized by the first embodiment could also be realized by this embodiment.

Figure 11:
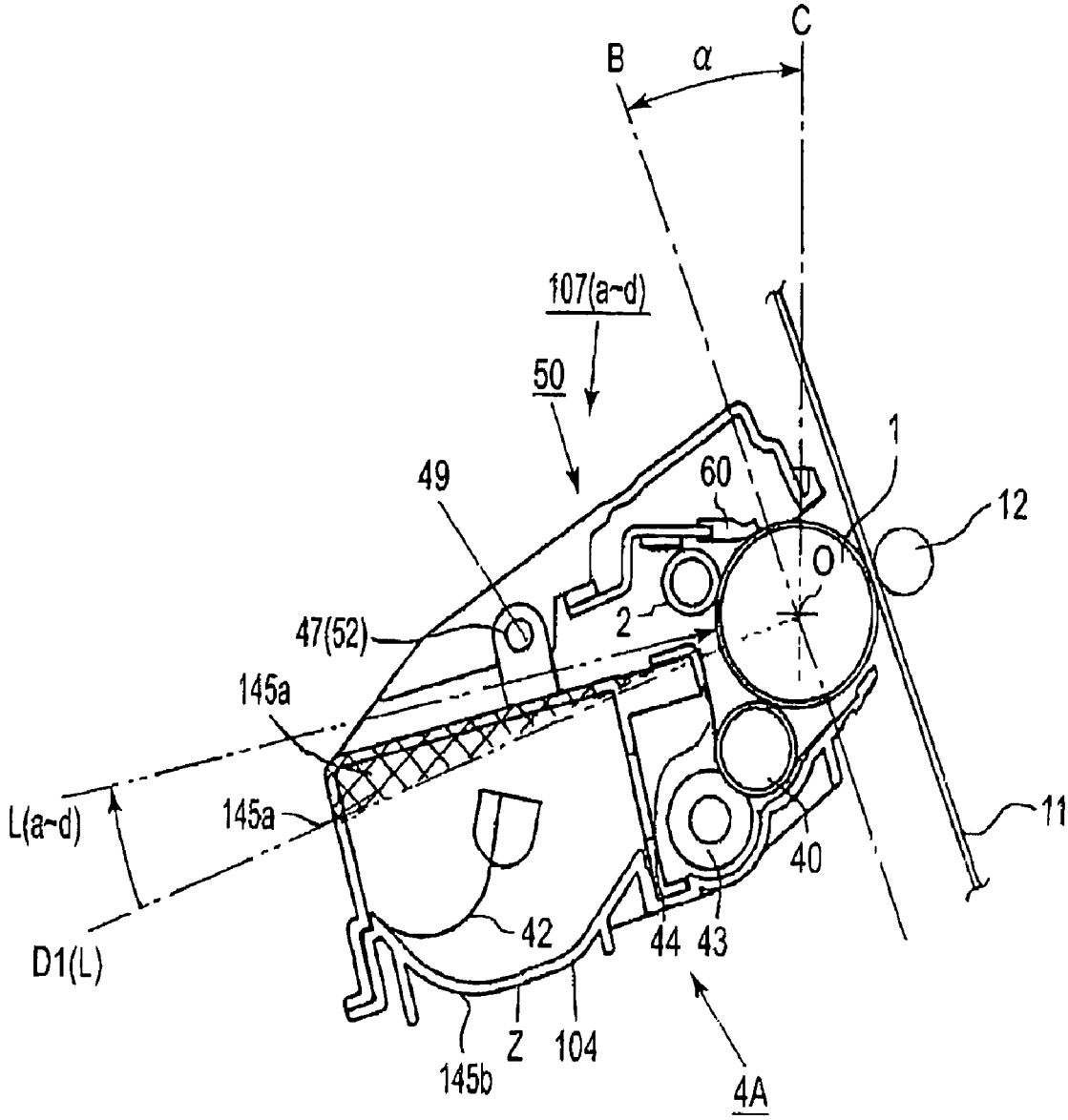
FIG. 11 is an enlargement of a part of FIG. 10.

Moreover, regarding the positioning of the development units 104(*a–d*), more specifically, the positional relationship among the photosensitive drum 1, the development roller 40, the toner supply roller 43, the development blade 44, and the toner stirring member 42, in each development unit 104 (*a–d*), which are experientially known to be essential to the development of an electrostatic latent image, in FIG. 11 which is a vertical sectional view of one of the development units, can be made to be closer to that in an image forming apparatus in which the plurality of cartridges 7 are vertically stacked roughly in parallel, with each cartridge 7 being horizontally placed. In other words, with the above described structural arrangement in which the plane B is tilted in the counterclockwise direction relative to the vertical direction, and the exposure paths La–Ld are also tilted in the clockwise direction (upward) relative to the above described D perpendicular to the plane B, the positioning of the developing apparatuses in this embodiment can be made similar to the positioning of the developing apparatuses in an image forming apparatus in accordance with the prior art, that is, an image forming apparatus in which the plurality of cartridges are vertically stacked in parallel, in other words, the cartridge compartments of the main assembly are vertically stacked in parallel, so that when the cartridges are in their image forming positions in the main assembly, their bottom surfaces are positioned virtually horizontal. Further, a part of one of the developing apparatus 104(*a–d*) of the cartridge 7 intersects the aforementioned plane B, and is positioned above the plane D, which coincides with the axial line of the photosensitive drum 1 and perpendicular to the plane B.

With the employment of the above described structural arrangement, the development units 104(*a–d*) of the cartridges can be made greater in volumetric ratio than the cleaning apparatus 6 of the cartridges, making it possible to optimize the volumetric ratio between the development unit and cleaning apparatus 6 of the cartridges, because the amount of the toner actually consumed for development is greater than the amount of the waste toner. Further, the cartridge 7 can be reduced in size.

Incidentally, also in this embodiment, the electrostatic transfer belt 11 may be replaced with an intermediary transfer belt (intermediary transferring member), onto which the toner images formed in the cartridges are transferred (primary transfer), and from which the transferred toner images are transferred (secondary transfer) onto the recording medium S.

According to the present invention, it is possible to reduce an electrophotographic image forming apparatus in height. Further, it is possible to improve the operational efficiency with which the cartridges are mounted into, or removed from, the main assembly of an electrophotographic image forming apparatus, by an operator.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 099503/2004, 099504/2004, 144839/2004 and 253011/2004 filed Mar. 30, 2004, Mar. 30, 2004, May 14, 2004, Aug. 31, 2004, respectively, which are hereby incorporated by reference.

What is claimed is:

1. An electrophotographic image forming apparatus for forming an image on a recording material, said image forming apparatus being usable with one or a plurality of process cartridges each of which includes an electrophotographic photosensitive drum, a developing roller configured and positioned to develop an electrostatic latent image formed on the electrophotographic photosensitive drum, a developer accommodating portion configured and positioned to accommodate a developer to be used by the developing roller to develop the electrostatic latent image, a cleaning member configured and positioned to remove from the electrophotographic photosensitive drum the developer remaining on the electrophotographic photosensitive drum after a developed image formed on the electrophotographic photosensitive drum is transferred onto the recording material, and a removed developer accommodating portion configured and positioned to accommodate the removed developer removed from the electrophotographic photosensitive drum by the cleaning member, said apparatus comprising:

a plurality of mounting portions each of which is configured and positioned to detachably mount one of the plurality of process cartridges, wherein in each of said mounting portions, one of the plurality of process cartridges is mounted to be inclined downwardly so that, with respect to a mounting direction in which the mounted process cartridge is mounted to one of said mounting portions and to a main assembly of said electrophotographic image forming apparatus, an upstream side of the mounted process cartridge is higher than a downstream side of the mounted process cartridge, wherein when process cartridges are set in said mounting portions, a phantom plane passing through each of the axes of the electrophotographic photosensitive drums of the mounted process cartridges is inclined in a downstream direction with respect to a vertical plane passing through the axis of the electrophotographic photosensitive drum of the bottommost mounted process cartridge, wherein a part of one of the process cartridges mounted to one of said mounting portions and a part of another one of the process cartridges mounted to another one of said mounting portions, positioned above said one of said mounting portions, overlap each other, as seen along a plane perpendicular to said phantom plane from the area outside said electrophotographic image forming apparatus through which the process cartridges are mounted to said electrophotographic image forming apparatus;

light projecting means for projecting light corresponding to image information onto the electrophotographic photosensitive drum of each process cartridge mounted to said mounting portions; and feeding means for feeding the recording material, wherein a line in the mounting direction forms an angle with the perpendicular plane so as to be tilted upward with respect to the perpendicular plane in the area outside said electrophotographic image forming apparatus through which the process cartridges are mounted to said electrophotographic image forming apparatus.

2. An apparatus according to claim 1, wherein the part of the process cartridge mounted to the said one of said mounting portions is a part of the removed developer accommodating portion of the cartridge mounted to said one of said mounting portions, and the part of the process cartridge mounted to said another one of said mounting portions is a part of the developer accommodating portion of the cartridge mounted to the another one of said mounting portions.

3. An apparatus according to claim 2, wherein said light projecting means comprises a semiconductor laser element or a light emitting diode.

4. An electrophotographic image forming apparatus for forming an image on a recording material, said image forming apparatus being usable with one or a plurality of process cartridges, each of which includes an electrophotographic photosensitive drum, a developing roller configured and positioned to develop an electrostatic latent image formed on the electrophotographic photosensitive drum, a developer accommodating portion configured to accommodate a developer to be used by the developing roller to develop the electrostatic latent image, a cleaning member configured and positioned to remove from the electrophotographic photosensitive drum the developer remaining on the electrophotographic photosensitive drum after a developed image formed on the electrophotographic photosensitive drum is transferred onto the recording material, and a removed developer accommodating portion configured and positioned to accommodate the removed developer removed from the electrophotographic photosensitive drum by the cleaning member, an upper unit containing the electrophotographic photosensitive drum, the cleaning member and the removed developer accommodating portion, and a lower unit containing the developer accommodating portion and rotatably connected with the upper unit, said apparatus comprising:

a plurality of mounting portions each of which is configured and positioned to detachably mount one of the plurality of the process cartridges, wherein in each of said mounting portions, one of the process cartridges is mounted to be inclined downwardly so that, with respect to a mounting direction in which the mounted process cartridge is mounted to one of said mounting portions and to a main assembly of said electrophotographic image forming apparatus, an upstream side of the mounted process cartridge is higher than a downstream side of the mounted process cartridge, wherein when the process cartridges are set in said mounting portions, a phantom plane passing through each of the axes of the electrophotographic photosensitive drums of the mounted process cartridges is inclined in a downstream direction with respect to a vertical plane passing through the axis of the electrophotographic photosensitive drum of the bottommost mounted process cartridge;

light projecting means for projecting a laser beam corresponding to image information onto the electrophotographic photosensitive drum of each process cartridge mounted to said mounting portions, said light projecting means applying the light to the electrophotographic photosensitive drum from above a plane which is perpendicular to the phantom plane and which passes through an axis of the electrophotographic photosensitive drum; and feeding means for feeding the recording material, wherein a line in the mounting direction forms an angle with the perpendicular plane so as to be tilted upward with respect to the perpendicular plane in the area outside said electrophotographic image forming apparatus through which the process cartridges are mounted to said electrophotographic image forming apparatus.

5. An apparatus according to claim 4, wherein said light projecting means applies the light to the electrophotographic photosensitive drum between adjacent mounted process cartridges.

6. An apparatus according to according to any one of claims 1–5, wherein the recording material is in the form of a sheet material, said apparatus further comprising an electrostatic transfer belt configured and positioned to electrostatically attract the sheet material and carry the sheet material along the electrophotographic photosensitive drums of the process cartridges set in said mounting portions.

7. An apparatus according to claim 6, further comprising an openable covering member at an upstream portion, with respect to the mounting direction, of said apparatus, wherein the process cartridges are mounted to or demounted from said mounting portions through an opening provided by opening said covering member.

* * * * *

UNITED STATES PATENT AND TRADEMARK OFFICE

CERTIFICATE OF CORRECTION

PATENT NO. : 7,164,875 B2
APPLICATION NO. : 10/951604
DATED : January 16, 2007
INVENTOR(S) : Shigeo Miyabe et al.

It is certified that error appears in the above-identified patent and that said Letters Patent is hereby corrected as shown below:

ON THE TITLE PAGE At Item (54), Title of the Invention
"PLURALITY PROCESS" should read --PLURALITY OF PROCESS--.

ON THE TITLE PAGE At Item (56), Foreign Patent Documents
"8 190245 A" should read --8-190245 A--.

COLUMN 1:
Line 5, "PLURALITY PROCESS" should read --PLURALITY OF PROCESS--.

COLUMN 5:
Line 7, "toward" (second occurrence) should be deleted.

COLUMN 7:
Line 36, "state." should read --state,--.
Line 38, "cartridge" should read --cartridges--.

COLUMN 12:
Line 64, "tilted 30" should read --tilted so--.
Line 66, "105(a-d)." should read --105(a-d),--.

COLUMN 13:
Line 4, "for" should read --stands for--.
Line 29, "angle t β" should read --angle β--.

UNITED STATES PATENT AND TRADEMARK OFFICE

CERTIFICATE OF CORRECTION

PATENT NO. : 7,164,875 B2
APPLICATION NO. : 10/951604
DATED : January 16, 2007
INVENTOR(S) : Shigeo Miyabe et al.

It is certified that error appears in the above-identified patent and that said Letters Patent is hereby corrected as shown below:

COLUMN 20:
Line 21, "according to" (second occurrence) should be deleted.

Signed and Sealed this

Twelfth Day of August, 2008

JON W. DUDAS
*Director of the United States Patent and Trademark Office*